US005168990A

United States Patent [19]

Johnson

[11] Patent Number: 5,168,990

[45] Date of Patent: Dec. 8, 1992

[54] BEVERAGE BOTTLE CARRIER

[76] Inventor: William J. Johnson, 5621 34th Ave. South, Minneapolis, Minn. 55417

[21] Appl. No.: 710,104

[22] Filed: Jun. 4, 1991

[51] Int. Cl.[5] ..... B65D 73/00

[52] U.S. Cl. ..... 206/151; 206/159; 294/87.2

[58] Field of Search ..... 206/139, 145, 147, 150, 206/151, 159, 160, 162; 220/23.4; 294/87.2, 87.22, 87.28

[56] References Cited

U.S. PATENT DOCUMENTS

| | | | |
|---|---|---|---|
| D. 180,901 | 9/1957 | Glazer | 206/151 |
| 3,028,189 | 4/1962 | Gialanella | 206/145 |
| 3,033,412 | 5/1962 | Fox | 220/23.4 |
| 4,248,470 | 2/1981 | Yuda | 206/151 |
| 4,569,440 | 2/1986 | Steiger | 206/159 |
| 4,917,428 | 4/1990 | Sola | 206/145 |

*Primary Examiner*—Jimmy G. Foster
*Attorney, Agent, or Firm*—Clayton R. Johnson

[57] ABSTRACT

A carrier for carrying at least two beverage bottles which may be cumbersome to hand carrier, for example a conventional 2 liter pop bottles, and that have an enlarged diametric flange on the bottleneck adjacent to the bottle cap, an elongated bar having a bottle gripper at each end thereof for releasably gripping the bottleneck just below the flange. Each gripper has an arcuate cutout that is defined by an arcuate edge that extends through an angle of more than 180 degrees and of a radius of curvature slightly larger than the outer radius of curvature of the bottleneck just below the flange. Further each gripper has a bottle insertion slot that at one end opens to the respective cutout and at the opposite end opens outwardly of the carrier for permitting the bottle being manually moved through the slot and into the cutout and manually removed from the carrier, the outer radii of curvature of flange being substantially greater than that of the cutout and the bottleneck just below the flange. The insertion slot is defined by edges that converge toward the cutout to form a throat, the carrier being of a resiliency to permit the bottleneck being moved through the throat, but of a rigidity to retain two bottles in about the same relationship as in a container. The bar may serve as a handle or in an embodiment for carrying four bottles, two carriers that each is of the above construction may have the bars interconnected by a handle.

3 Claims, 2 Drawing Sheets

BEVERAGE BOTTLE CARRIER

BACKGROUND OF THE INVENTION

A beverage carrier that is adapted for carrying two or more beverage bottles, for example two 2 liter bottles, by one hand of a consumer without being in a container, for example a bag.

At the present time it is common for a consumer when handling a few beverage bottles, for example carrying them from a store to a mode of transportation or between the mode of transportation and a place of residence or a place for a picnic to carry them in their arms ar a container such as a bag or a box. Many times it is very inconvenient to carry the bottles in such a fashion. In order to provide a convenient manner of carrying a two beverage bottles or more, this invention has been made.

SUMMARY OF THE INVENTION

The beverage carrier includes an elongated bar portion that at opposite ends is joined to bottle grippers that are adapted for releasably holding two beverage bottles in the same spaced relationship that the bottles are in crate or other container that is commonly used for transporting the bottles from the bottler and the store. The bar may serve as a handle, or if the carrier is of the type for carrying four bottles than there is provide a second bar having opposite ends joined to two additional beverage bottle grippers and a handle that at opposite ends is joined to the mid-portions of the bars whereby the four bottle grippers will retain four bottles in the same spaced relationship that the bottles are in a crate or other container that is used for transporting from the bottller to the store. Each gripper has an arcuately curved cutout that extends through an arc that extends through angle of slightly more that 180 degrees that in conjunction with the limited resiliency of the grippers will releasably engage the bottlenecks just below the enlarge bottle flange which in turn is just below the bottle cap and retained the bottle in gripped relationship until manually pulled away from the gripper. Further each gripper has an entry slot that opens to the respective arcuate cutout to permit the bottles being moved to be gripped by the carrier, remove therefrom and permit the carrier being reused.

One of the objects of this invention is to provide a new and novel beverage carrier for releasably carrying two or more beverage bottles having an enlarge annular flange just below the bottle cap. A further object of this invention is to provide a bottle carrier having new and novel bottle grippers for releasably engaging the bottleneck of a beverage bottle to facilitate carrying two or four bottles. In furtherance of the last mentioned object, it is an another object to provide a bottle carrier that is readily reusable and has a handle for being carried by one hand with the bottles extending in depending relationship to the bottle grippers.

BRIEF DESCRIPTION OF THE DRAWINGS

Referring to FIGS. 1 and 2, the first embodiment of the invention, generally designated 10, includes an elongated, generally rectangular bar (straight) 11 that at its opposite ends is integrally joined (formed) with the bifurcated bottle grippers 12 and 14 respectively. The grippers 12, 14 adjacent to their juncture with the ba: have arcuate cutouts 17, 18 defined by circular edges 17*c*, 18*c* respectively that extend through angles significantly greater than 180 degrees, advantageously at least about 190 degrees, and desireably less than about 240 degrees, in part depending upon the outer diameter of the bottleneck portion to be extended into the cutout and the thickness of the gripper. Thus opposite terminal ends 17*a*, 17*b* of edge 17*c* and 18*a*, 18*b* of edge 18*c* are transversely spaced by a dimension slightly less than the minimum outer diameter of the bottleneck 20 of the beverage bottle, generally designated 21, just below the enlarged diametric flange 22 of the bottle. The flange is just below the bottle cap (closure) 23 when it is threaded onto the bottleneck to sealingly close the bottle.

Figure 1:
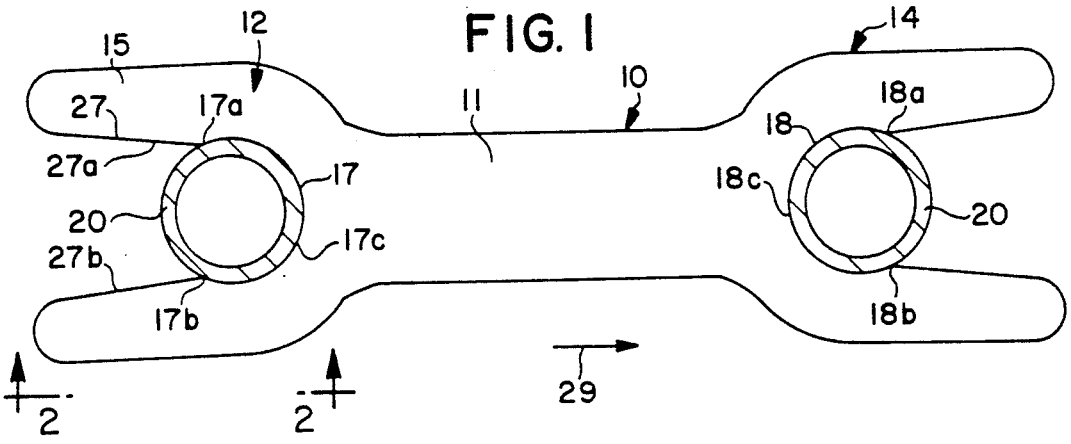
FIG. 1 is a plan view of the first embodiment of the invention together with a cross section of two bottlenecks that is generally taken along the line and in the direction of the arrows 1—1 of FIG. 2.

The gripper 12 has bifurcated legs 15 extending longitudinally outwardly of the gripper portion that has the cutout 17 to define a bottle insertion slot 27 that at its longitudinal inner end opens to the cutout 17 and at its opposite end opens longitudinally outwardly of the carrier. The slot 27 is defined by edges 27*a*, 27*b* of the legs 15 that converge toward the cutout 17 and intersect with ends 17*a*, 17*b* respectively while the gripper 14 has bifurcated legs 24 extending longitudinally outwardly of the gripper portion having the cutout 18 to define a bottle insertion slot 28 that opens to the cutout 18 and at the opposite end opens longitudinally outwardly of the carrier. The slot 28 is defined by gripper edges 28*a*, 28*b* that converge toward one another in a direction toward the cutout 18 and terminate at ends 18*a*,18*b*. Thus the intersection of the circular edge of the circular edge 18 with the edges 28*a*, 28*b* form a second throat. The transverse dimension of each throat is less than the minimum dimension of the outer diameter of the bottleneck below the flange. Preferably the edges 27*a*, 27*b* and edges 28*a*, 28*b* are transversely centered relative to the central axis of elongation L—L of the carrier which in turn passes through the centers P, P of curvature of the edges 17*c*, 18*c* of the cutouts. Accordingly the edges of each insertion slot are of the same angle relative to the central axis but at an opposite angle of taper.

The grippers advantageously are of the same size and shape, but open longitudinally outwardly in longitudinally opposite directions. Further, advantageously the transverse dimensions of the carrier that are take in a plane perpendicular to the longitudinal axis L—L are the same, including the transverse spacing of edges of the grippers that define the insertion slots, on either transverse side of the axis are equal.

The carrier of the first embodiment is made of plastic and is of sufficiently rigidity to hold two bottles in the same spaced relationship that the two bottles are in when in two adjacent compartments 25*b* in a row in a bottle crate, generally designated 25. At the same time the gripper portions are of sufficient resilience that the bottle may be moved, for example in the direction of the arrow 29 relative to the gripper 12, and through the gripper slot to have over half of the vertical portion of the bottleneck just below the flange pass through the gripper throat and into the cutout to abut against the cutout circular edge. At this time, due to the transverse dimension of the throat (transverse spacing of the juncture 17*a* from 17*b*), and the edge 17*c* extends through an arc which extends through an angle of over 180 degrees, the bottleneck is resiliently retained in gripped relationship to the carrier to retained the major transverse cross sectional portion of the bottleneck in the cutout until the bottle is manually pulled in a direction longitudinally away from the bar 11. The carrier may move a limited amount in a vertical direction relative to the bottle, the amount depending upon the taper of the bottleneck downwardly of the flange 22 and the difference between the radius of curvature of the cutout circular edge and the outer radii of curvature of the bottleneck adjacent to the flange. With reference thereto the outer radius of curvature of the flange is substantially greater than the radius of curvature of each cutout and greater than the transverse dimension of the throat even when the bottleneck is being moved through the throat.

Figure 3:
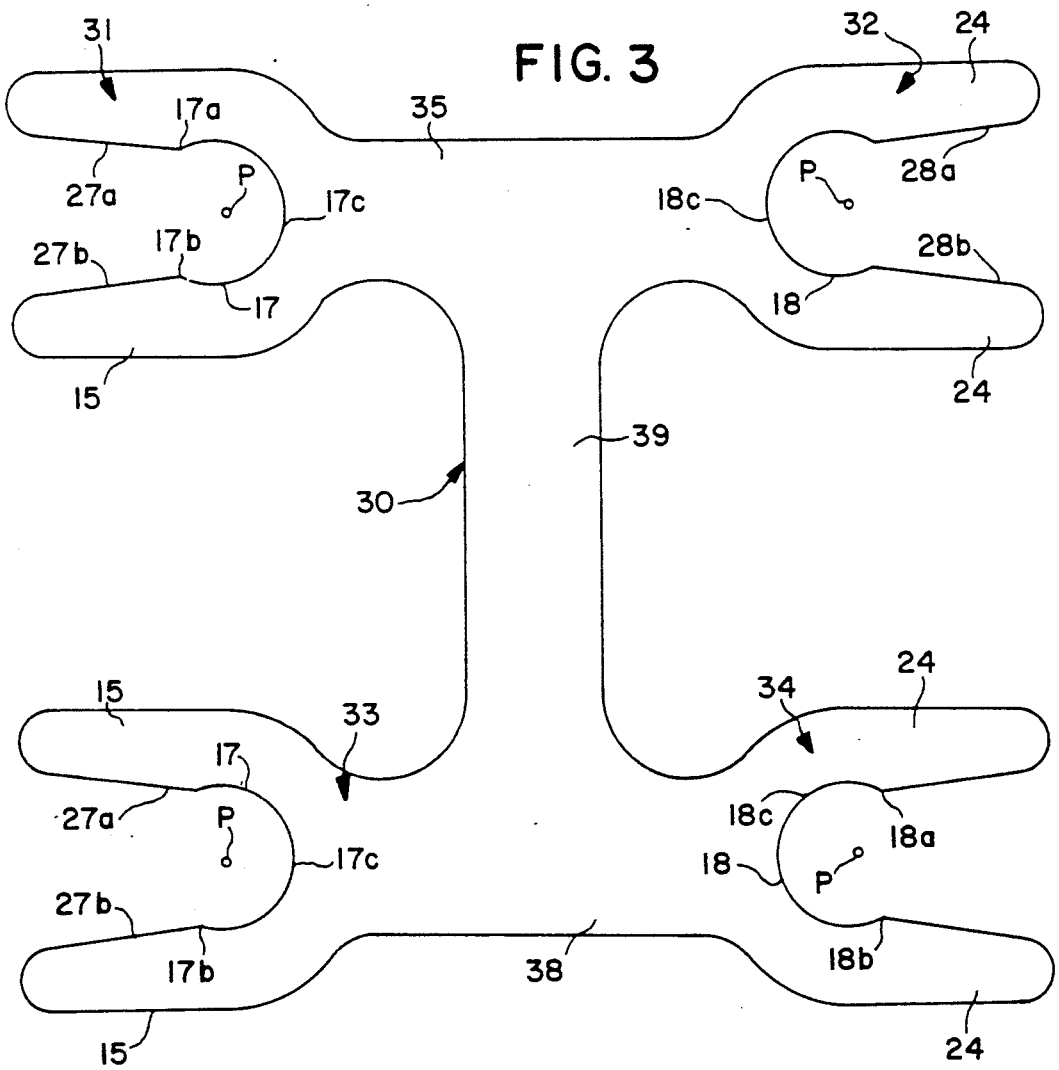
FIG. 3 is a plan view of a second embodiment of the invention.

Referring to FIG. 3, the second embodiment, generally designated 30, includes a pair of transversely spaced grippers 31, 33 that are of the same size and shape as gripper 17 and a pair of transversely spaced grippers 32, 34 that are of the same size and shape as grippers 18. The grippers 31, 32 are integrally joined (formed) with the respective longitudinally adjacent end of the longitudinally elongated straight bar 35. Similarly the grippers 33, 34 are integrally joined (formed) with the respective longitudinally adjacent end of the longitudinally elongated straight second bar 38. The mid-portions of the transversely adjacent, longitudinally extending edges of the bars 35, 38 are integrally joined to the transverse opposite ends of the transversely elongated handle (bar) 39. The centers P of the radii curvature of the circular edges 17*c*, 17*c*, 18*c*, 18*c* of the grippers 31–34 are located at the corner of a geometric square, the radii of curvature of the circular edges of the four cutouts being the same. Thus the longitudinal spacing of the centers P of, for example, the grippers 33, 34 is the same as the transverse spacing of the centers of the grippers 31, 32 and also the same as the horizontal centers of compartments of a bottle crate or container, generally designated 25, for transporting such bottles, for example between the bottler and the store. The container may or may or may not have dividers 25*a* that divide it into a plurality of compartments 25*b* for the bottles. The handle 39 is of a sized and shape to be conveniently lifted and carry four beverage bottles, for example, two 2 litter bottles with only one hand. Further, in plan view the transverse and longitudinal center of the handle is located at the intersection of the diagonal extending between the centers P of the circular edges of the cutouts of grippers 31, 34 with the diagonal extending between the centers P of the circular edges of the cutouts of the grippers 32, 33.

Advantageously both embodiments of the invention may have top and bottom surfaces that are substantially planar and parallel to one another, other than at the rounded junctures of the vertical edges with the horizontal edges. With the carriers of this invention the weight of the bottles and their contents in being hand carried is transmitted through the bottle flanges to the carrier grippers with by far the major part (with more than 0.9 ths) of the bottles being carried extends below the carrier (in depending relationship to the carrier).

With reference to using the carrier of this invention for carrying bottle, desireably the axial thickness of the flange is substantially less than the maximum radial dimension that the flange extends radially outwardly of the bottleneck just below the flange. Advantageously the radial dimension of the flange is at least about 1.5 times its axial thickness with the flange bottom surface at least initially extending predominantly outwardly radially as contrasted to vertically.

Figure 4:
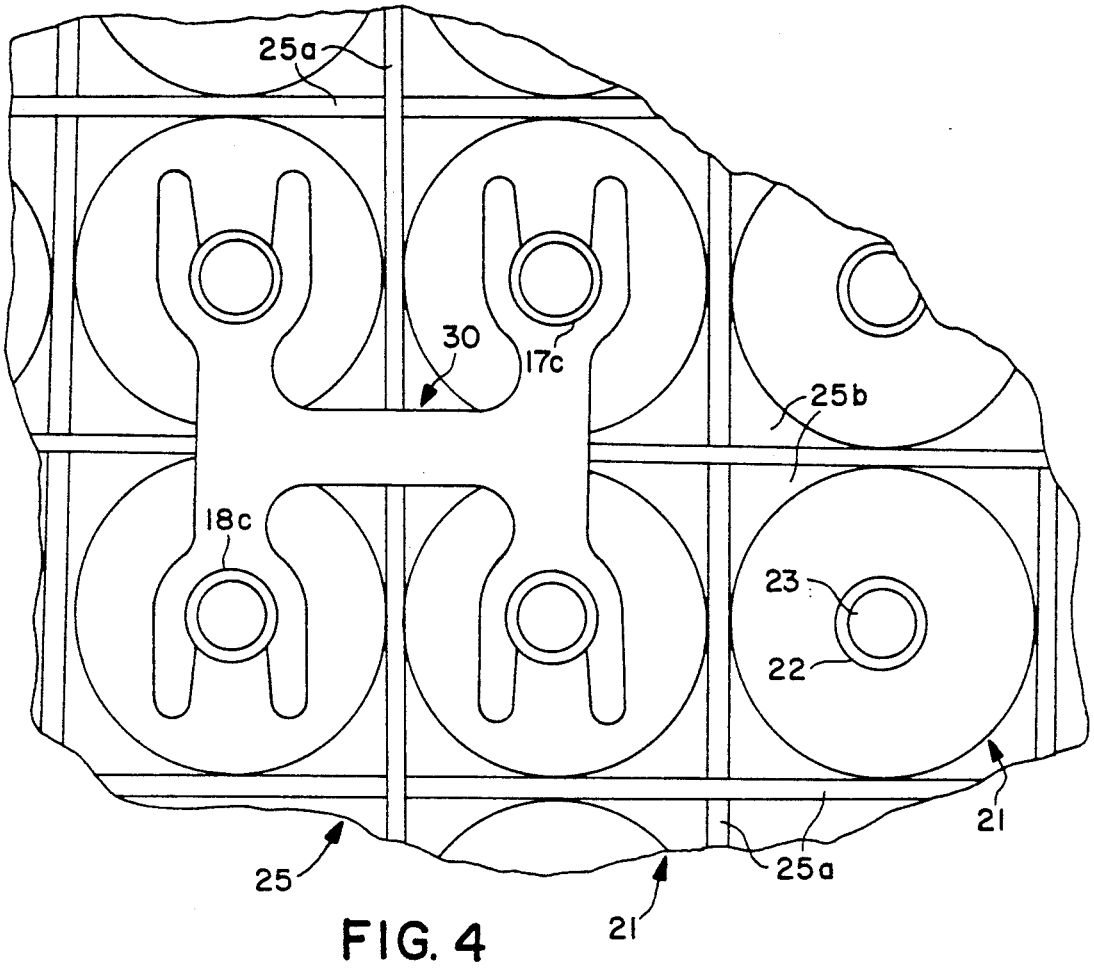
FIG. 4 is a fragmentary, somewhat diagrammatic plan view of the second embodiment showing the relationship of the carrier relative to bottles in a bottle crate.
Figure 2:
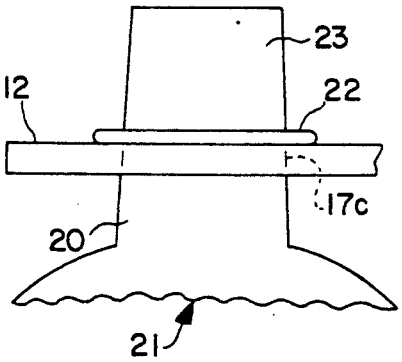
FIG. 2 is a fragmentary side view of the upper portion of a beverage bottle and a carrier gripper in engagement therewith that is generally taken along the line and in the direction of the arrows 2—2 of FIG. 1.

If desired, prior to shipping or selling a plurality of bottles there may be provided one or more carriers in gripping relationship to bottles in the container such as show in FIG. 4 for the second embodiment.

What is claimed is:

1. A carrier having a central longitudinal axis for dependingly carrying at least two bottles that have bottlenecks with enlarged diametric flanges just below the bottle caps for closing the bottles and bottleneck diametric portions just below and adjacent the flange of minimum outer diameters just below the flange that are substantially less than the maximum outer diameter of the flange, comprising a longitudinally elongated bar having longitudinally opposite first and second ends, a first bottle gripper joined to the bar first end to extend longitudinally away therefrom and a second bottle gripper joined to the bar second end to extend longitudinally away therefrom in a direction opposite the direction that the first gripper extends away from the bar, each gripper having a cutout substantially defined by a generally circular gripper edge that extends arcuately through an angle of at least somewhat more than 180 degrees and of a radius of curvature more than the minimum radius of curvature of the outer diametric portion of the bottle that is to be carried, each gripper circular edge extending through an angle less than about 240 degrees, and a pair of legs having adjacent edges diverging in a direction away from the cutout to define a bottle insertion slot that has one end opening to the cutout to form a throat and an opposite end remote from the cutout, the dimension of the throat being less than the outer diameter of the bottleneck portion adjacent to the flange, the bar comprising a carrier hand and each gripper opening longitudinally outwardly of its cutout.

2. A carrier for dependingly carrying at least two bottles that have bottlenecks with enlarged diametric flanges just below the bottle caps for closing the bottles and bottleneck diametric portions just below and adjacent the flange of minimum outer diameters that are substantially less than the maximum outer diameter of the flange, comprising a first longitudinally elongated, generally straight bar having longitudinally opposite first and second ends, a first bottle gripper joined to the first bar first end to extend longitudinally away therefrom and a second bottle gripper joined to the bar second end to extend longitudinally away therefrom in a direction opposite the direction that the first gripper extends away from the first bar, each gripper having a cutout substantially defined by a generally circular gripper edge that extends arcuately through an angle of at least somewhat more than 180 degrees and of a radius of curvature more than the minimum radius of curvature of the outer diametric portion of the bottle that is to be carried, and a pair of legs having adjacent edges diverging in a direction away from the cutout to define a bottle insertion slot that has one end opening to the cutout to form a throat and an opposite end remote from the cutout, the dimension of the throat being less than the outer diameter of the bottleneck portion adjacent to the flange, a second longitudinally elongated generally straight bar having a longitudinally opposite first and second ends and a third and a fourth bottle gripper joined to the second bar first and second ends respectively, each of the third and fourth gripper having a cutout of substantially the same size and shape of the cutout of the first and second gripper respectively and a pair of legs having adjacent edges that diverge in a direction away from the respective cutout to define a bottle insertion slot that has one end opening to the adjacent cutout and an opposite end that opens remote from the second bar, the bars having transversely adjacent midportions, and a transversely elongated handle having opposite ends joined to the first and second bars midportions respectively and extending transversely therebetween to retain the longitudinal bars in transverse spaced relationship.

3. A carrier according to claim 2 wherein each gripper portion has a circular edge portion that defines the respective cutout and that the legs for each gripper are joined to the gripper portion to extend longitudinally away therefrom.

* * * * *